United States Patent [19]

Wisler et al.

[11] 4,243,727

[45] Jan. 6, 1981

[54] SURFACE SMOOTHED TOOL JOINT HARDFACING

[75] Inventors: Allen E. Wisler, Houston; Leo D. Lane, Pearland, both of Tex.

[73] Assignee: Hughes Tool Company, Houston, Tex.

[21] Appl. No.: 790,795

[22] Filed: Apr. 25, 1977

[51] Int. Cl.[3] ..... B22F 7/04

[52] U.S. Cl. ..... 428/558; 219/77; 219/76.14; 219/76.15; 175/374; 428/627; 428/935; 175/375

[58] Field of Search ..... 428/558, 627, 932, 935, 428/547; 219/77, 76.14, 76.15; 175/374, 375; 427/37, 205, 422, 423

[56] References Cited

U.S. PATENT DOCUMENTS

| | | | |
|---|---|---|---|
| 3,334,975 | 8/1967 | Quaas | 428/558 |
| 3,715,999 | 2/1973 | Schwayder | 428/558 |
| 4,055,742 | 10/1977 | Brown | 428/558 |

*Primary Examiner*—Benjamin R. Padgett
*Assistant Examiner*—J. L. Barr
*Attorney, Agent, or Firm*—Robert A. Felsman

[57] ABSTRACT

A tool joint hardfacing containing sintered tungsten carbide granules embedded in an alloy steel matrix, with the surface substantially free of protruding granules to decrease casing wear during well drilling. The hardfacing is applied in a single application by rotating the drill pipe, providing an arc between a consummable steel wire and the pipe to create a weld puddle, and reciprocating the wire parallel to the pipe axis to create a band. Sintered tungsten carbide granules are gravity fed from an orifice directly into the arc and precipitate toward the bottom of the matrix to provide a smooth surface. The bottom of the matrix appears to be harder than the top.

5 Claims, 6 Drawing Figures

SURFACE SMOOTHED TOOL JOINT HARDFACING

SUMMARY OF THE INVENTION

The invention may be summarized as an improved tool joint hardfacing that contains sintered tungsten carbide granules in a single layer of alloy steel matrix, with the surface substantially free of protruding granules. This hardfacing is applied by dropping the sintered tungsten carbide granules directly into the arc of a consumable steel wire, rather than behind the arc, to produce a hardfacing with a smooth exterior. While the overall density of embedded granules is generally the same as with prior art methods, the concentration appears to be greater toward the bottom of the hardfacing deposit and the matrix is harder in this region. Additional features, objects and advantages of the invention will become apparent in the following description.

BACKGROUND OF THE INVENTION

1. Field of the Invention

This invention is adapted especially for hardfacing on tool joints used with drill pipe for earth boring operations, particularly those used inside casing which may be damaged due to excessive wear from some of the more conventional tool joint hardfacings.

2. Description of the Prior Art

The most common drill pipe used in earth boring operations has connection members or tool joints on each end that are larger in diameter than the drill pipe. Annular bands of hardfacing are commonly deposited on each tool joint. One type hardfacing has macroscopic sintered tungsten carbide granules within and alloy steel matrix. Sintered tungsten carbide granules, as explained in U.S. Pat. No. 3,800,891, comprise microscopic grains of tungsten carbide held together by a binder of an iron group metal, usually cobalt. Sintered tungsten carbide hardfacing is normally applied on tool joints by rotating the tool joint, providing an arc with a consummable steel wire, discharging an inert gas around the wire, and gravity feeding sintered tungsten carbide particles into the weld puddle behind the wire.

One disadvantage of the resulting sintered tungsten carbide hardfacing is that many of the granules remain only partially embedded in the matrix, giving a rough abrasive exterior. In deep wells, intermediate strings of casing are set as the well is drilled. While drilling deeper through a string of intermediate casing, the rough surface of the hardfacing can abrade and damage the casing. Consequently, it is advantageous to have a hardfacing surface free of protruding tungsten carbide granules. Pure alloy hardfacings have not been found as wear resistant as tungsten carbide granule hardfacing. One prior art hardfacing employs one layer of an alloy surface layer applied over a first layer of tungsten carbide granule hardfacing. This may be satisfactory when properly applied but adds an additional operation since two layers are used. Further, dual layers of hardfacing may tend to crack more due to the thermal shock of reheating the first layer. Also, it can result in poor granule distribution if reheating is not accurately controlled.

Another prior art hardfacing employed cast tungsten carbide particles of approximately 100 mesh size, which is much smaller than the preferred sintered tungsten carbide granules. The smallest sintered tungsten carbide granules now in common usage are approximately 45 mesh. Cast tungsten carbide, as explained in U.S. Pat. No. 3,800,891, is essentially an eutectic of monotungsten carbide and ditungsten carbide, with no additional material holding the grains of a particle together. Such granules when dropped directly into the arc tend to bury deeply in the molten matrix. The resulting hardfacing was not as wear resistant as hardfacings containing large size cast tungsten carbide particles, although the surface was smoother.

Feeding sintered tungsten carbide granules directly into the arc was thought to be undesirable, even though in the past the smaller size cast tungsten carbide particles were fed directly into the arc. Cast tungsten carbide melts at a much higher temperature than sintered tungsten carbide, which was expected to dissolve excessively if fed directly into the arc.

DESCRIPTION OF THE PREFERRED EMBODIMENT

Figure 1:
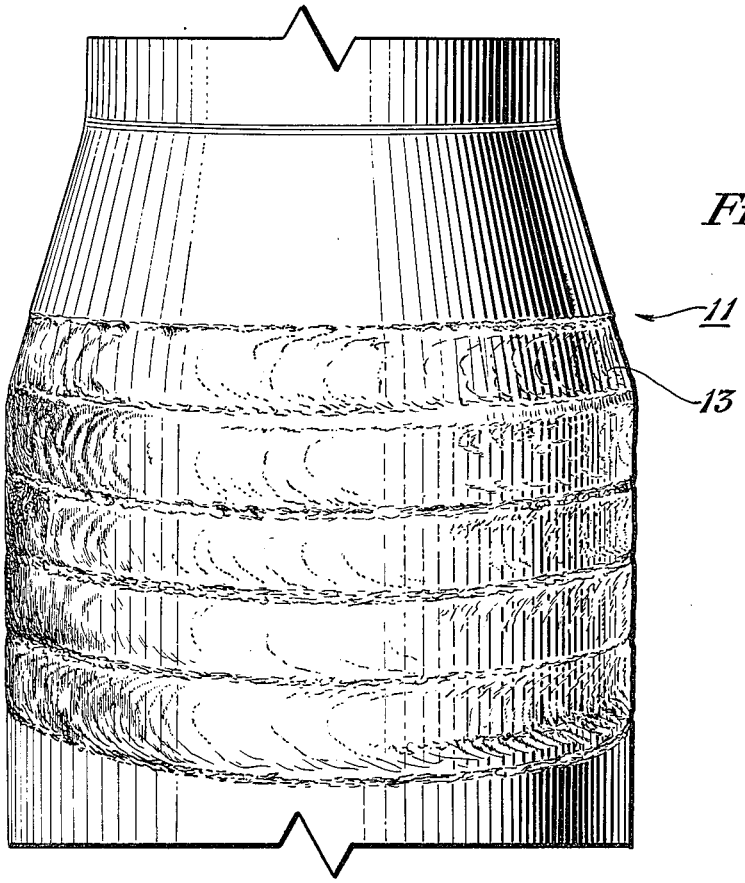
FIG. 1 is a fragmentary side elevational view of a tool joint containing hardfacing applied in accordance with the principles of this invention.
Figure 3:
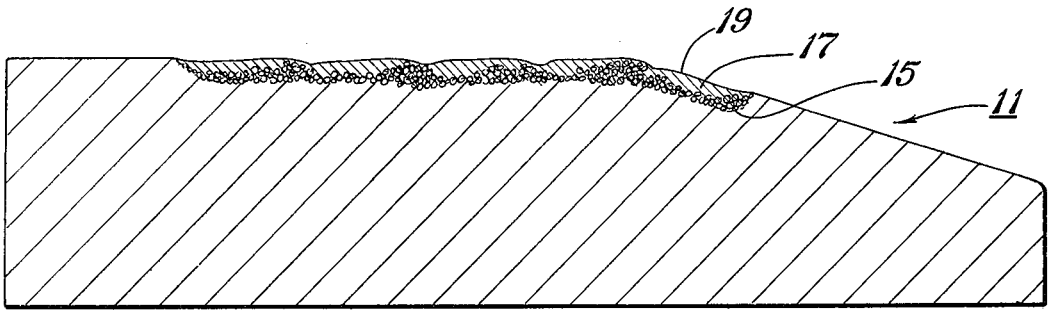
FIG. 3 is a sectional view of a portion of the tool joint hardfacing deposit of FIG. 1.

Referring to FIG. 1, a portion of a tool joint 11 is shown with annular bands 13 of hardfacing. As shown in FIG. 3, sintered tungsten carbide granules 15 are embedded in the matrix 17 of the hardfacing deposit. The surface 19 is smooth and is substantially free of protruding granules 15. This hardfacing has been deposited by a hardfacing apparatus 21 shown partially in FIG. 5.

Apparatus 21 includes means (not shown) for holding the tool joint 11 in a horizontal position and for rotating it in the direction shown by arrow 22. A guide member 23 is mounted with its lower surface 24 above the tool joint 11 approximately $\frac{3}{4}$ inch. Guide member 23 includes means (not shown) for feeding a consumable steel wire 25 through its center toward the tool joint. Wire 25 is positioned approximately $\frac{1}{8}$ inch from the surface 26 of tool joint 11, leaving approximately $\frac{5}{8}$ inch of wire exposed. The longitudinal axis 27 of the tool guide member 23 is inclined at an angle $\alpha$ of approximately 23° with respect to the vertical plane 29. Wire 25 serves as an electrode, and the point at which the arc is generated between wire 25 and tool joint surface 26 is spaced from top dead center 31 a circumferential distance equal to an angle $\beta$ of approximately 13° with respect to the vertical plane 29. Top dead center 31 is a point at which vertical plane 29 passes through the tool joint exterior surface 26 and the longitudinal axis 30 of the tool joint.

An inert gas, preferably argon and designated as numeral 33, is discharged from guide member 23 and envelopes wire 25. Preferably 5 percent oxygen is mixed with the inert gas. Means (not shown) are included in the apparatus to reciprocate the guide member 24 parallel with the longitudinal axis 30 of the tool joint.

Figure 5:
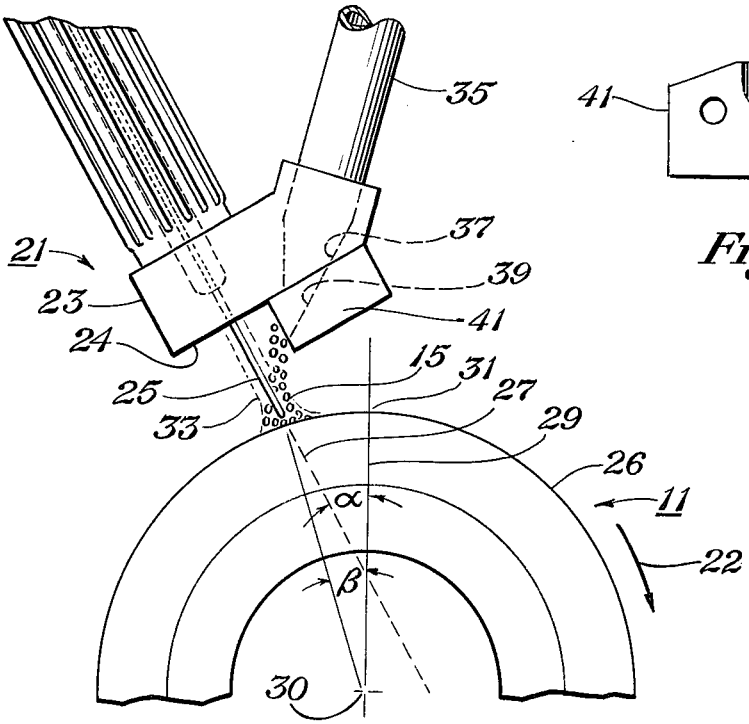
FIG.5 is a front elevational view of some of the welding apparatus used to apply the hardfacing on the FIG. 1 tool joint as seen in fragmentary end view.
Figure 6:
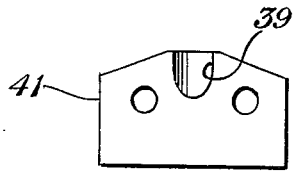
FIG. 6 is a top elevational view of the extension block portion of the welding apparatus shown in FIG. 5.

Granules of sintered tungsten carbide 15 are gravity fed from a tube 35 which is attached to guide member 23 and inclined with respect to it. Granules 15 are fed through an orifice 37 of tube 35, thence through an orifice 39 of an extension block 41, and onto the surface 26 of tool joint 11. Orifice 39 extends flush from orifice 37 at the same angle of inclination. As shown in FIG. 6, orifice 39 is a channel or slot formed in the forward edge of extension block 41. The forward edge of orifice 39 is positioned approximately ¼ inch from wire 25. The angle of inclination of orifice 39 is selected so that most of the granules 15 will fall directly into the arc, as shown in FIG. 5. In order to achieve the desired densities, orifices 37 and 39 must be of certain cross-sectional areas, consequently, although concentrated, a certain amount of the particles will not fall directly into the arc, but will fall in close proximity to it.

In operation, granules of sintered tungsten carbide containing 5 to 7 percent cobalt are preferred although other ranges and iron group binders are feasible. One preferred size is minus 14 mesh to plus 30 mesh. To achieve a desired hardfacing density of 0.020 to 0.022 pounds per square inch, orifice 39 is approximately ⅛ inch wide and ⅛ inch high. Tool joint 11 is rotated at 20 to 22 inches per minute, and the guide member is reciprocated 85 to 95 oscillation per minute along a ⅞ inch stroke. A slight overlap provides bands of ¾ inch width. An arc is struck to create a weld puddle, the temperatures generated being approximately 5000° F. Argon gas containing 5 percent oxygen is pumped into the arc. The granules of sintered tungsten carbide are dropped into the weld puddle at the arc. Preferably 0.5 to 0.6 pounds per minute of sintered tungsten carbide granules are fed into the weld puddle or arc to achieve the desired density. The deposit averages 0.10 inch in thickness. The tool joint is subsequently allowed to cool in air and is not heat treated. The resulting product, as shown in FIGS. 1 and 3, has a surface 19 free of protruding granules. Some of the granules are embedded near the surface, but substantially all of each granule is below the surface. Most of the granules are concentrated toward the bottom of the hardfacing deposit. The deposit contains approximately 50 percent sintered tungsten carbide granules and 50 percent matrix by weight.

Figure 2:
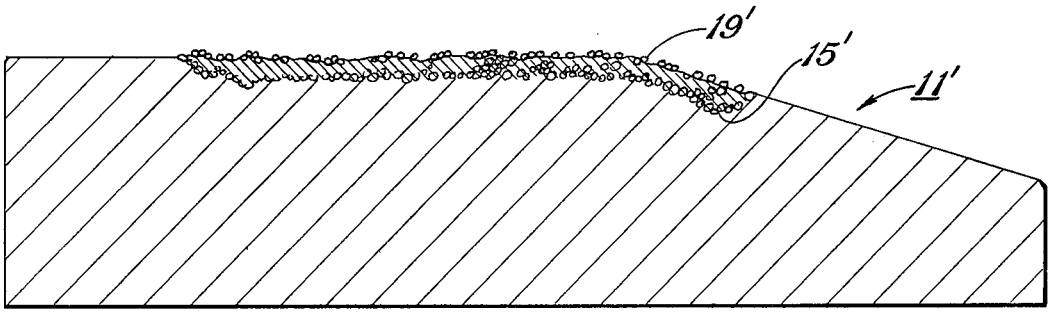
PRIOR ART Fig. 2
FIG. 2 is a sectional view of a portion of a tool joint hardfacing deposit applied in accordance with a prior art method.
Figure 4:
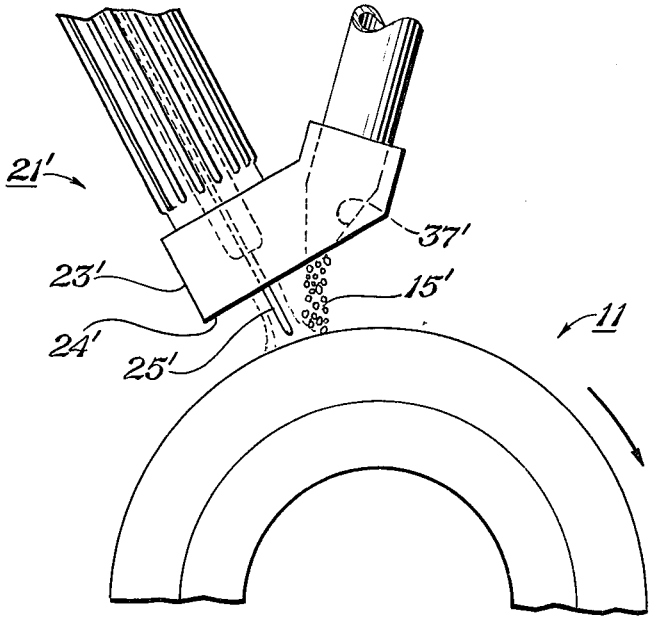
PRIOR ART Fig. 4
FIG. 4 is a front elevational view of a prior art welding apparatus for applying sintered tungsten carbide hardfacing to a tool joint as seen in fragmentary end view.

FIG. 4 illustrates the prior art apparatus 21' for applying sintered tungsten carbide hardfacing to a tool joint. The extension block 41 is not used, and the amount of wire 25' that protrudes from the lower surface 24' of guide member 23' is approximately half that of the apparatus shown in FIG. 5. The inclinations of guide member 21' and orifice 37' are selected so that the granules 15' fall into the weld puddle at a cooler point behind the arc to minimize alloying. The result, as shown in FIG. 2, shows a number of granules protruding from the surface 19'.

Specimens were prepared in accordance with the teachings of this invention and in accordance with the prior art method of FIG. 4. Hardness tests were conducted with a Tukon tester. The results were as follows:

| Depth From Surface (inches) | Rockwell "C" (converted from Knopp Hardness) New Hardfacing | Prior Art |
|---|---|---|
| .002 | 55.2 | 51.5 |
| .010 | 53.3 | 53.0 |
| .018 | 51.3 | 53.6 |
| .026 | 51.5 | 52.7 |
| .034 | 52.1 | 51.8 |
| .042 | 59.1 | 51.3 |
| .050 | 59.4 | 49.2 |
| .058 | 56.1 | 50.3 |
| .066 | 56.4 | 48.6 |
| .074 | 56.7 | 49.5 |
| .082 | 53.0 | 57.4 |
| .090 | 60.1 | 59.7 |
| .098 | 65.5 | 52.7 |
| .106 | 68.4 | 48.3 |

The new hardfacing deposit is harder near its bottom than at the surface, while the prior art hardfacing is no harder and even less hard near the bottom than at the surface. This difference is believed to be caused by more alloying of the granules in the new hardfacing. This alloying of granules in the matrix increases its hardness.

This additional hardness near the bottom in the concentrated granule area is believed to be advantageous. As the deposit wears and more granules become exposed, the matrix should protect the granules from extension above the surface and maintain a slick wearing surface with good wear resistance properties. Laboratory tests have indicated that the new hardfacing has equal or greater wear resistance than the prior art hardfacing of FIG. 4.

It should be apparent that an invention having significant improvements has been provided. The hardfacing has a smooth exterior, yet uses relatively large size sintered tungsten carbide particles. The abrasion resistance is as good or better than the prior art sintered tungsten carbide particles. The hardfacing is deposited in a single operation at no additional cost.

While the invention has been shown in only one of its forms, it should be apparent to those skilled in the art that it is not so limited but is susceptible to various changes and modifications without departing from the spirit thereof.

I claim:

1. A tool joint for drill pipe used in earth boring operations, the tool joint having annular bands of hardfacing on the exterior, the hardfacing comprising sintered tungsten carbide granules in an alloy steel matrix, the improvement comprising said hardfacing being deposited in a single application by rotating the tool joint while providing an arc between a metal wire and the tool joint to create a weld puddle, and feeding the granules into the weld puddle from an orifice, the application being at a temperature and speed effective to precipitate the granules toward the bottom of the matrix and prevent substantial protrusion of granules from the surface.

2. A tool joint for drill pipe used in earth boring operations, the tool joint having annular bands of hardfacing on the exterior, the hardfacing comprising sintered tungsten granules in an alloy steel matrix, the improvement comprising the hardfacing being applied by rotating the tool joint while providing an arc between a metal wire and the tool joint to create a weld puddle, and feeding the granules into the weld puddle from an orifice, the application being each band having a single layer of matrix with the granules concentrated near the bottom of the matrix and with the surface of the matrix being substantially free of protruding granules.

3. A tool joint for drill pipe used in earth boring operations, the tool joint having annular bands of hardfacing on the exterior, the hardfacing comprising sintered tungsten granules in an alloy steel matrix, the improvement comprising the hardfacing being applied by rotating the tool joint while providing an arc between a metal wire and the tool joint to create a weld puddle, and feeding the granules into the weld puddle from an orifice, the application being each band having a single layer of matrix with the granules concentrated near the bottom of the matrix and with the surface of the matrix being substantially free of protruding granules, the matrix being harder at the bottom of the deposit than at the top.

4. A tool joint for drill pipe used in earth boring operations, the tool joint having annular bands of hardfacing on the exterior, the hardfacing comprising sintered tungsten carbide granules the improvement comprising in an alloy steel matrix with the surface substantially free of protruding granules, the hardfacing being deposited by rotating the tool joint while providing an arc between a consumable steel wire and the tool joint within a stream of substantially inert gas to create a weld puddle, reciprocating the wire parallel to the tool joint axis substantially the width of the band, and feeding the granules by gravity into the weld puddle from an orifice that is positioned so as to cause substantially all of the falling granules to fall directly into the arc.

5. The tool joint according to claim 4 wherein the sintered tungsten carbide granules contain a binder of 5 to 7 percent by weight.

* * * * *